US012687100B2

(12) United States Patent
Johnson et al.

(10) Patent No.: US 12,687,100 B2
(45) Date of Patent: Jul. 21, 2026

(54) MITIGATING TORSIONAL DRILL STRING OSCILLATIONS

(71) Applicant: Schlumberger Technology Corporation, Sugar Land, TX (US)

(72) Inventors: Ashley Bernard Johnson, Cambridge (GB); Riadh Boualleg, Stonehouse (GB); Ross Lowdon, Stonehouse (GB)

(73) Assignee: Schlumberger Technology Corporation, Sugar Land, TX (US)

( * ) Notice: Subject to any disclaimer, the term of this patent is extended or adjusted under 35 U.S.C. 154(b) by 0 days.

(21) Appl. No.: 19/318,402

(22) Filed: Sep. 4, 2025

(65) Prior Publication Data

US 2026/0071536 A1 Mar. 12, 2026

Related U.S. Application Data

(60) Provisional application No. 63/693,407, filed on Sep. 11, 2024.

(51) Int. Cl.
*E21B 44/00* (2006.01)
*E21B 7/06* (2006.01)

(52) U.S. Cl.
CPC ..... *E21B 44/005* (2013.01); *E21B 7/068* (2013.01)

(58) Field of Classification Search
CPC ..... E21B 7/068; E21B 7/04–10
See application file for complete search history.

(56) References Cited

U.S. PATENT DOCUMENTS

| | | | | |
|---|---|---|---|---|
| 5,507,353 | A | 4/1996 | Pavone | |
| 2009/0044981 | A1* | 2/2009 | Sheppard | E21B 7/06 175/24 |
| 2013/0066471 | A1* | 3/2013 | Wang | G05B 13/024 700/275 |
| 2013/0118812 | A1* | 5/2013 | Clausen | E21B 7/06 175/267 |
| 2016/0160567 | A1* | 6/2016 | Downton | E21B 44/005 175/73 |
| 2020/0011751 | A1* | 1/2020 | Kazemi Miraki | E21B 47/024 |
| 2022/0349260 | A1* | 11/2022 | Hamzah | E21B 7/06 |

OTHER PUBLICATIONS

Johnson, A. et al., Characterizing Drilling Dysfunction: Taking the T Out of HFTO, SPE-208720-MS, presented at the IADC/SPE International Drilling Conference and Exhibition, Galveston, Texas, USA, 2022, 15 pages.

* cited by examiner

*Primary Examiner* — Theodore N Yao
(74) *Attorney, Agent, or Firm* — Jeffrey D. Frantz

(57) ABSTRACT

Wellbore operations include rotating a drill string in a wellbore. The drill string includes a rotary steerable system having at least three pads configured to contact the wellbore wall to steer a direction of drilling. These are simultaneously actuated while rotating the drill string to mitigate stick slip, harmonic stick slip, or backward whirl oscillations.

8 Claims, 4 Drawing Sheets

MITIGATING TORSIONAL DRILL STRING OSCILLATIONS

CROSS REFERENCE TO RELATED APPLICATIONS

This application claims priority to U.S. Provisional Patent Application No. 63/693,407 which was filed on Sep. 11, 2024, and is incorporated herein by reference in its entirety.

FIELD

Disclosed embodiments relate generally to downhole drilling operations and more particularly to mitigating torsional drill string oscillations during such operations.

BACKGROUND

Severe dynamic conditions are often encountered while drilling subterranean wellbores (e.g., geothermal wells or oil and gas exploration and production wells). Such dynamic conditions may include, for example, axial vibrations including bit bounce, lateral vibrations including whirl, and torsional vibrations including stick slip. Lateral vibrations are generally the most destructive type of drill string vibration and sometimes cause large shocks as the bottom hole assembly (BHA) impacts the wellbore wall. In particular, backward whirl can cause violent vibrations, and may cause high frequency, large magnitude bending moments that lead to severe component and connection fatigue and even to catastrophic failure of the drill string.

Owing to their highly destructive potential, dynamic oscillations have been the subject of considerable evaluation. Mitigation efforts commonly involve developing balanced drill string components and identifying drilling parameters that reduce damaging oscillation tendency. Despite these intensive efforts, torsional modes remain a challenging problem to the driller. There is room for improved mitigation methods, particularly methods for mitigating backward whirl and harmonic stick slip oscillations.

SUMMARY

In one example embodiment, a wellbore operation comprises rotating a drill string in a wellbore, the drill string including a rotary steerable system having at least three pads configured to contact the wellbore wall to steer a direction of drilling; measuring a stick slip amplitude while rotating; comparing the measured stick slip amplitude with a stick slip threshold; and simultaneously actuating the at least three pads to mitigate stick slip oscillations when the measured stick slip amplitude exceeds the stick slip threshold.

In another example embodiment, a wellbore operation comprises rotating a drill string in a wellbore, the drill string including a rotary steerable system having at least three pads configured to contact the wellbore wall to steer a direction of drilling; measuring a at least one of a harmonic stick slip amplitude and a backward whirl amplitude while rotating; comparing the measured harmonic stick slip amplitude with a corresponding harmonic stick slip threshold and/or comparing the backward whirl amplitude with a backward whirl threshold; and simultaneously actuating the at least three pads to promote stick slip oscillations and thereby mitigate harmonic stick slip or backward whirl when the measured harmonic stick slip amplitude exceeds the harmonic stick slip threshold or when the backward whirl amplitude exceeds the backward whirl threshold.

This summary is provided to introduce a selection of concepts that are further described below in the detailed description. This summary is not intended to identify key or essential features of the claimed subject matter, nor is it intended to be used as an aid in limiting the scope of the claimed subject matter.

BRIEF DESCRIPTION OF THE DRAWINGS

For a more complete understanding of the disclosed subject matter, and advantages thereof, reference is now made to the following descriptions taken in conjunction with the accompanying drawings, in which.

DETAILED DESCRIPTION

Disclosed wellbore operations may include rotating a drill string in a wellbore. The drill string includes a rotary steerable system having at least three pads configured to contact the wellbore wall to steer a direction of drilling. A stick slip amplitude may be measured while rotating and compared with a stick slip threshold. Harmonic stick slip and/or whirl amplitudes may also be measured while rotating and compared with corresponding threshold(s). The pads in the rotary steerable system may be simultaneously actuated to either mitigate stick slip oscillations when the measured stick slip amplitude exceeds the stick slip threshold or to promote stick slip oscillations and thereby mitigate harmonic stick slip and/or backward whirl when the measured harmonic stick slip amplitude and/or the backward whirl amplitude exceed the corresponding threshold(s).

Figure 1:
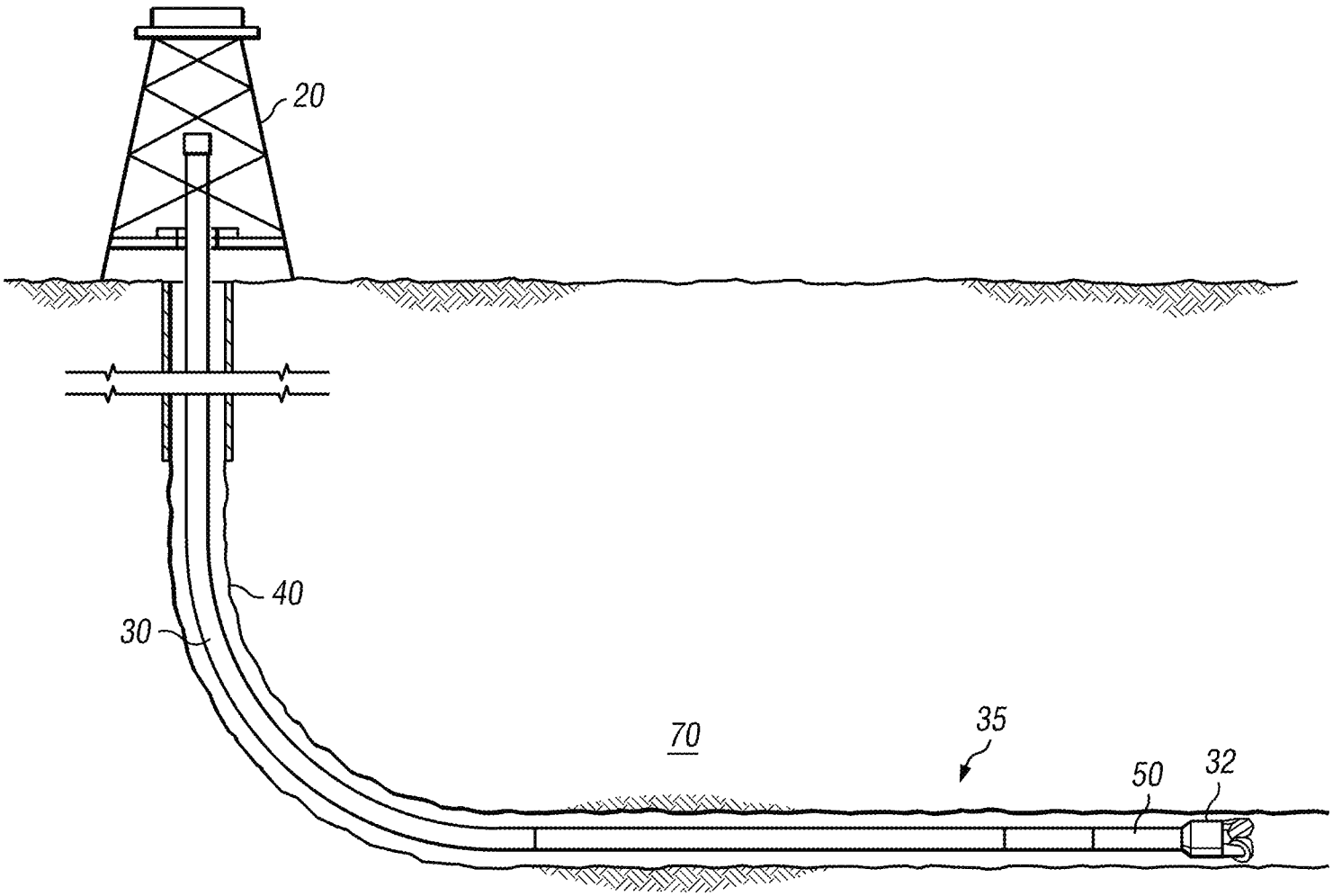
FIG. 1 depicts a disclosed drilling rig.

FIG. 1 depicts an example drilling rig 20 positioned over a subterranean formation 70. The drilling rig may include a derrick and a hoisting apparatus (not shown) for raising and lowering a drill string 30, which, as shown, extends into wellbore 40 and includes a drill bit 32 deployed at the lower end of a bottom hole assembly (BHA) 35. In the depicted embodiment, the drill string 30 further includes a rotary steerable system (RSS) 50 deployed above the bit. The drilling rig 20 may be deployed in either onshore or offshore applications (an onshore application is depicted). Moreover, the wellbore may be inclined at substantially any angle and may include, for example, vertical, building, turning, and/or horizontal sections (as depicted). The disclosed embodiments are not limited to any particular wellbore configuration. In the depicted example, the wellbore 40 may be formed in subsurface formations 70, for example, by rotary drilling in a manner that is well-known to those of ordinary skill in the art (e.g., via known directional drilling techniques).

As is known to those of ordinary skill, the drill string 30 may be rotated, for example, at the surface to drill the well (e.g., via a rotary table) or via a hydraulically powered motor deployed in or above the BHA 35. A pump may deliver drilling fluid through the interior of the drill string 30 to the drill bit 32 where it exits the string via ports therein. The fluid may then circulate upwardly through the annular region between the outside of the drill string 30 and the wall of the wellbore 40. In this known manner, the drilling fluid lubricates the drill bit 32 and carries formation cuttings up to the surface.

It will be understood that the deployment illustrated on FIG. 1 is merely an example. Drill string 30 may include substantially any suitable downhole tool components, for example, including a steering tool such as a rotary steerable system, a downhole telemetry system, and one or more measurement while drilling (MWD) and/or logging while drilling (LWD) tools including various sensors for sensing downhole characteristics of the borehole and the surrounding formation. The disclosed embodiments are by no means limited to any particular drill string configuration.

Figure 2:
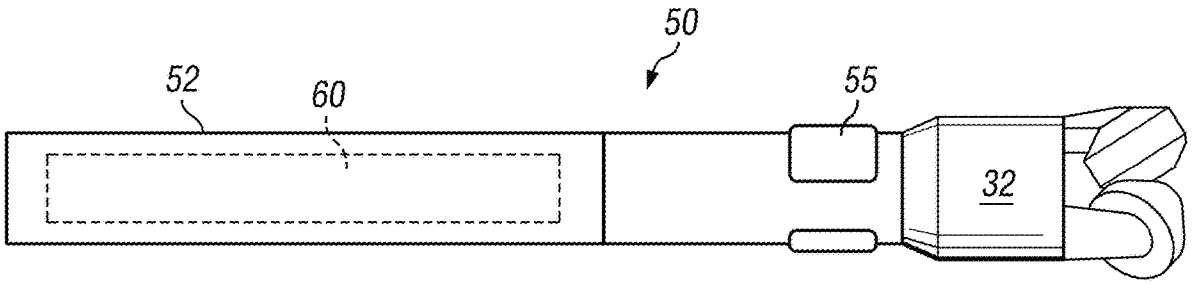
FIG. 2 depicts a disclosed rotary steerable system.

FIG. 2 depicts a schematic of an example RSS 50 and drill bit 32. In the depicted embodiment, the RSS 50 includes a plurality of (e.g., three) circumferentially spaced steering actuators 55 (also referred to as pads or blades) that are deployed on a tool collar (or body) 52. In the depicted embodiment, the blades 55 are configured to extend radially outward from the collar 52 and engage the wellbore wall to steer the direction of drilling (e.g., by pushing the bit 32 in a desired lateral direction). It will be appreciated that other steering mechanisms are known to those of ordinary skill in the art and that the disclosed embodiments are expressly not limited to push the bit configurations such as depicted.

The RSS 50 may further include a control unit 60 including an electronic controller (not depicted in the figure). A suitable controller may include, for example, one or more programmable processors, such as a digital signal processor or other microprocessors or microcontrollers that may be connected with electronic memory (solid-state memory). The controller may be configured to execute computer-readable program code embodying logic and therefore be utilized to execute the disclosed method embodiments. The electronic controller may further include sensors (such as accelerometers and magnetometers) configured to measure downhole oscillations such as stick slip, harmonic stick slip, and/or whirl. The controller may also be in electronic communication with sensors deployed elsewhere in the drill string 30 or BHA 35.

With continued reference to FIG. 2, in example embodiments, the control unit 60 may be a roll stabilized control unit. By roll-stabilized it is meant that the control unit may be substantially non-rotating with respect to the wellbore (or may be configured to rotate independently with respect to the drill collar and the pads). For example, various PowerDrive rotary steerable systems (available from SLB) include a drill collar that is intended to fully rotate with the drill string and an internal roll-stabilized control unit that rotates independently (e.g., to remain substantially rotationally geostationary). As is known to those of ordinary skill in the art, a roll stabilized control unit may be mounted on bearings such that it is rotationally decoupled from the collar. The rotational orientation or rotational speed of the control unit may be controlled by the co-action of first and second axially opposing alternators in combination with feedback provided by sensors in the control unit. The alternators may include corresponding impellers that are configured to rotate in opposing directions and apply corresponding opposing torques to the control unit. The amount of electrical load on the alternators may be changed in response to feedback from the sensors to vary the applied torques and thereby control the orientation or rotational speed of the housing.

The rotary steerable system 50 may include substantially any suitable RSS that utilizes the above described steering pads to contact the wellbore wall and thereby steer the direction of drilling. For example, The PowerDrive® X5, X6, and Orbit rotary steerable systems (available from SLB) make use of mud actuated pads that contact the borehole wall. Moreover, it will be appreciated that the RSS may include a steerable drill bit, such as the NEOSTEER® at bit steerable system available from SLB, in which the steering pads extend outward from the drill bit body into contact with the wellbore wall.

Torsional oscillations are commonly encountered during well drilling operations. Stick slip refers to a torsional oscillation induced by friction between drill string components and the borehole wall and is known to produce instantaneous drill string rotation speeds many times that of the nominal rotation speed of the table. For example, a portion of the drill string or BHA may stick to or catch on the borehole wall due to frictional forces causing the drill string to temporarily stop rotating. Meanwhile, the rotary table continues to turn resulting in an accumulation of torsional energy in the drill string. When the torsional energy exceeds the static friction between the drill string and the borehole wall, the energy is released suddenly in a rapid burst of drill string rotation. Stick slip oscillations commonly have a fundamental frequency on the order of 0.1 to 0.5 Hz depending on the length of the drill string.

Harmonic stick slip (HSS) oscillations are similar to stick slip in that these oscillations are torsional; however, harmonic stick slip oscillations occur at harmonics of the fundamental stick slip frequency. Damaging harmonics tend to be (but are not always) odd integer multiples of the fundamental frequency, for example, third, fifth, seventh, and so on, with fifth order harmonics and above generally being the most damaging. As such, harmonic stick slip oscillations commonly occur at a frequency of greater than about 0.2 Hz, for example, in a range from about 0.2 Hz to about 5 Hz. Harmonic oscillations are believed to cause severe damage to downhole tools, as well as connection fatigue, and excess wear to the drill bit and near-bit stabilizer blades.

While whirl is, strictly speaking, a lateral oscillation, it may be thought of as being closely related to torsional oscillations in that it is related to the rotation of the drill string. In forward whirl the direction of the whirling motion is the same as the direction of the BHA rotation. In backward whirl, the direction of the whirling motion is in the opposite direction to the direction of the BHA rotation. Whirl can also be chaotic, jumping back and forth between forward and backward whirl motion. Backward whirl is commonly considered to be more destructive and detrimental to the drilling operation since it can generate high frequency, large amplitude vibrations that damage downhole tools. Backward whirl is not only destructive to the BHA, but can also damage the integrity of the wellbore (as the BHA repeatedly strikes the wellbore wall).

One aspect of the disclosed embodiments was the realization that stick slip, harmonic stick slip, and whirl can be managed (or otherwise mitigated) via careful control of the steering blades on a rotary steerable (RSS) tool such as a PowerDrive RSS (available from SLB). In other words, it was realized that control of the steering blades can mitigate (reduce or even substantially eliminate) stick slip oscillations. It was further realized that control of the steering blades can promote stick slip at the fundamental frequency and thereby mitigate the more damaging harmonic stick slip and/or whirl (such as backwards whirl).

It will be appreciated that the disclosed embodiments are not strictly limited to while drilling activities in which the drill bit is rotating on bottom. It will be further appreciated that highly damaging vibrations can (and sometimes do) occur during other drilling related activities, for example, rotating the drill string and circulating drilling fluid when the drill bit is off bottom or when rotating while tripping. Therefore, it will be understood that the term "drilling" as used herein is used in the broader context to refer to drilling related activities whether or not the drill bit is on or off bottom.

Figure 3:
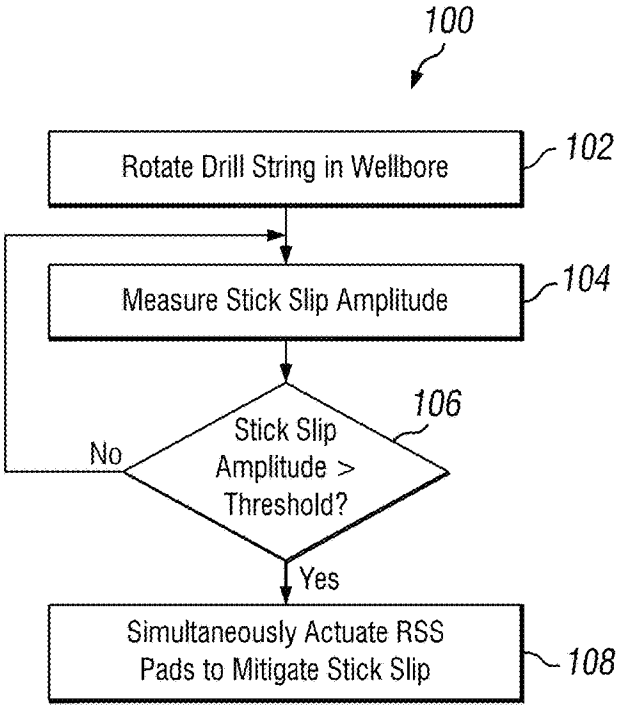
FIG. 3 depicts a flow chart of one example method for mitigating stick slip.

FIG. 3 depicts a flow chart of one example method 100 for mitigating stick slip oscillations during a wellbore operation. The method includes rotating a drill string in a wellbore at 102 (e.g., to drill the well). The stick slip amplitude may be measured at 104 while rotating the drill string. The measurement may include, for example, a maximum stick slip amplitude in a predetermined time interval or in a predetermined frequency range (e.g., at the fundamental frequency). The stick slip amplitude may be measured using any suitable measurement techniques, for example, employing downhole magnetometers configured to measure an instantaneous rotation rate of the drill string. The measurement may further include computing a Fast Fourier Transform (FFT) of the rotation rate measurements to evaluate a dominant or fundamental frequency or a stick slip amplitude at a frequency (or in a range of frequencies). The dominant frequency can also be determined by computing an FFT of the surface torque. The measured stick slip amplitude may be compared with a stick slip threshold at 106 (e.g., a predetermined threshold). When the stick slip amplitude is greater than or equal to the threshold, the RSS pads may be simultaneously actuated at 108 to mitigate the stick slip oscillations. Otherwise, the method may continue measuring the stick slip amplitude at 104 (as depicted).

With continued reference to FIG. 3, the intent of the simultaneous actuation of the RSS pads is to provide frictional torque that is synchronized and in phase with the fundamental stick slip frequency. In other words, the pads may be actuated to engage the wellbore wall in sync (in phase) with the periodic bursts of high drill string rotation rates. In this way (via the provided frictional torque), simultaneous actuation of the pads may mitigate stick slip by resisting drill string rotation at the higher rotational speeds. Therefore, in certain embodiments, method 100 may include measuring both the stick slip amplitude and the fundamental stick slip frequency at 104 and periodically actuating the RSS pads in phase with and at the fundamental stick slip frequency to mitigate the stick slip oscillations.

With continued reference to FIG. 3, it will be appreciated that actuation of the RSS pads may employ substantially any actuation mechanism. For example, simultaneous actuation of the pads may be achieved via actuating each pad independently (and simultaneously) in tool embodiments that employ electronic valves to control flow of the actuating fluid. However, energizing the pads simultaneously can be hydraulically inefficient (depending on the configuration of the RSS).

In an alternative embodiment, the pad actuation scheme may make use of a flow restriction at the hydraulic exhaust (where the fluid exits the pad cylinders). This restriction limits the speed at which the pads can exhaust fluid and thereby retract. As a result, rapid sequential actuation of the pads may in practice result in the pads being simultaneously actuated into contact with the wellbore wall. Therefore, in example embodiments, the pads may be actuated simultaneously via rapid sequential actuation. By rapid it may be meant that each pad is actuated at a frequency exceeding 5 Hz (e.g., exceeding 6 Hz, exceeding 7 Hz, exceeding 8 Hz, exceeding 9 Hz, or even exceeding 10 Hz). In example embodiments including three circumferentially spaced pads, rapid sequential actuation may mean that the pads are sequentially actuated at a time interval of less than about 0.1 seconds (e.g., less than about 0.07 seconds, less than about 0.05 seconds, less than about 0.04 seconds, or even less than about 0.03 seconds).

In embodiments that make use of an RSS having a roll stabilized control unit, rapid sequential actuation of the pads may be achieved, for example, by rotating the roll stabilized control unit in a direction opposite that of the drill collar rotation to achieve a differential rotation rate (a difference between the rotation rate of the drill collar and the rotation rate of the control unit) that exceeds a threshold. It will be appreciated that certain example RSSs make use of a spider valve that includes the above described flow restriction to the hydraulic exhaust. Rotating the control unit to achieve the high differential rotation rate (above the threshold) results in rapid sequential actuation of the pads which in turn may result, in practice, in simultaneous actuation of the pads. In example embodiments the differential rotation rate threshold may be 350 rpm (e.g., 400 rpm, 450 rpm, or even 500 rpm).

In some embodiments, the stick slip mitigation may include a passive mitigation. For example, rotation rate of the roll stabilized housing may be selected such that the differential rotation rate is less than the threshold during normal drilling (e.g., 300 or 350 rpm when the threshold is 400 rpm). In such an example, increasing the rotation rate of the collar, such as in periodic stick slip oscillations, may increase the differential rotation rate above the threshold and thereby automatically simultaneously actuate the pads to mitigate the stick slip.

Figure 4:
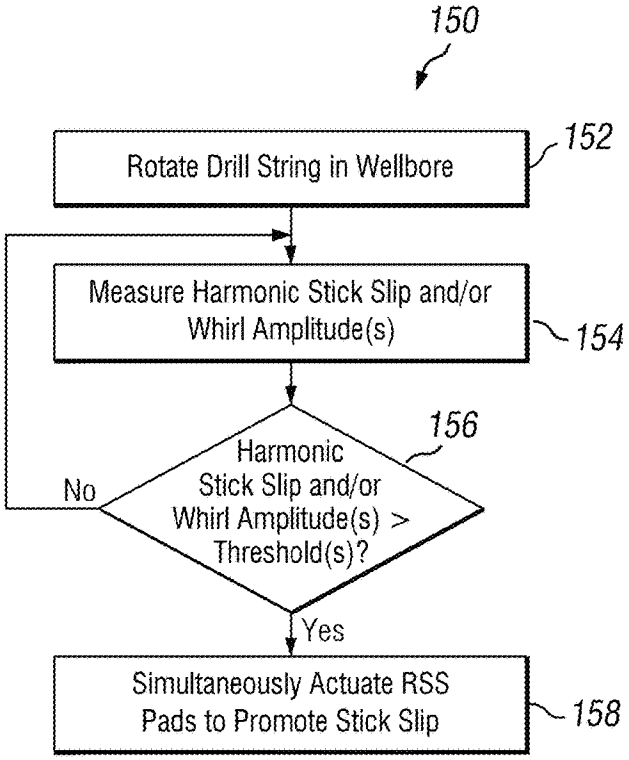
FIG. 4 depicts a flow chart of one example method for mitigating harmonic stick slip and/or whirl.

FIG. 4 depicts a flow chart of one example method 150 for mitigating harmonic stick slip oscillations and/or whirl (e.g., backwards whirl) during a wellbore operation. The method includes rotating a drill string in a wellbore at 152 (e.g., to drill the well). Harmonic stick slip and/or whirl may be measured at 154 while rotating the drill string. For example, torsional vibrations (e.g., accelerations) indicative of harmonic stick slip oscillations may be measured at 154. The torsional vibrations or accelerations may be measured, for example, via surface torque measurements made while rotating the drill string. A maximum torsional acceleration in a predetermined frequency window may be indicative of a harmonic stick slip amplitude. Lateral vibrations (e.g., accelerations) indicative of whirl may also be measured at 154. The lateral (radial) vibrations or accelerations may be measured, for example, via downhole accelerometer deployments in the RSS or elsewhere in the drill string. The measured harmonic stick slip and/or whirl may be compared with corresponding thresholds at 156. When the measured harmonic stick slip and/or whirl exceeds the threshold(s), the RSS pads may be simultaneously actuated to promote stick slip oscillations at the fundamental frequency at 158 and thereby mitigate the harmonic stick slip and/or whirl. Otherwise, the method may continue measuring the harmonic stick slip and/or whirl amplitudes at 154 (as depicted). Simultaneous actuation of the RSS pads may be implemented, for example, as described above with respect to method 100.

With continued reference to FIG. 4, the intent of the simultaneous actuation of the RSS pads is to provide frictional torque that promotes stick slip, for example, by resisting drilling string rotation when the rotation rate of the drill collar is low. In such embodiments, the simultaneous actuation of the RSS pads may have the same frequency as the fundamental stick slip frequency, but may be out of phase (or out of sync) with the periodic bursts of high drill string rotation rates that occur during stick slip. In this way (via the provided frictional torque), simultaneous actuation of the pads may promote stick slip by enabling drill string rotation at the higher speeds. Therefore, in certain embodiments, method 150 may further include measuring both the stick slip amplitude and the fundamental stick slip frequency at 154 and periodically actuating the RSS pads out of phase with the periodic high amplitude rotation rates to promote stick slip and mitigate the harmonic stick slip or whirl oscillations.

It will be appreciated that harmonic stick slip and backward whirl are often negatively correlated with stick slip at the fundamental frequency as disclosed in commonly assigned US Patent Publication No: 2025-0084752, filed Sep. 11, 2024, which is incorporated by reference in its entirety herein. In other words, stick slip oscillations at the fundamental frequency do not generally occur simultaneously with the more damaging vibrational modes such as backward whirl and harmonic stick slip. One aspect of the disclosed embodiments (particularly method 150) was the realization that harmonic stick slip and/or whirl may be displaced by stick slip at the fundamental frequency and that such stick slip can be promoted via simultaneous actuation of RSS pads, for example, as described above.

With still further reference to FIGS. 3 and 4, it will be appreciated that methods 100 and 150 may be implemented automatically. For example, stick slip, harmonic stick slip, and/or whirl oscillations may be automatically and continuously be measured while drilling at 104 and 154. These measurements may be automatically evaluated with respect to the corresponding thresholds at 106 and 156. The RSS pads may then be automatically actuated (simultaneously) when one or more of the measured quantities exceeds the corresponding threshold (as described above). In this way, stick slip oscillations at the fundamental frequency and/or the more damaging harmonic stick slip and or whirl oscillations may be automatically mitigated. Moreover, it will be appreciated that the measuring and evaluating steps may run automatically in the background and the RSS pad actuation may be automatically implemented only when one or more of the measured oscillations exceeds the corresponding threshold.

Figure 5:
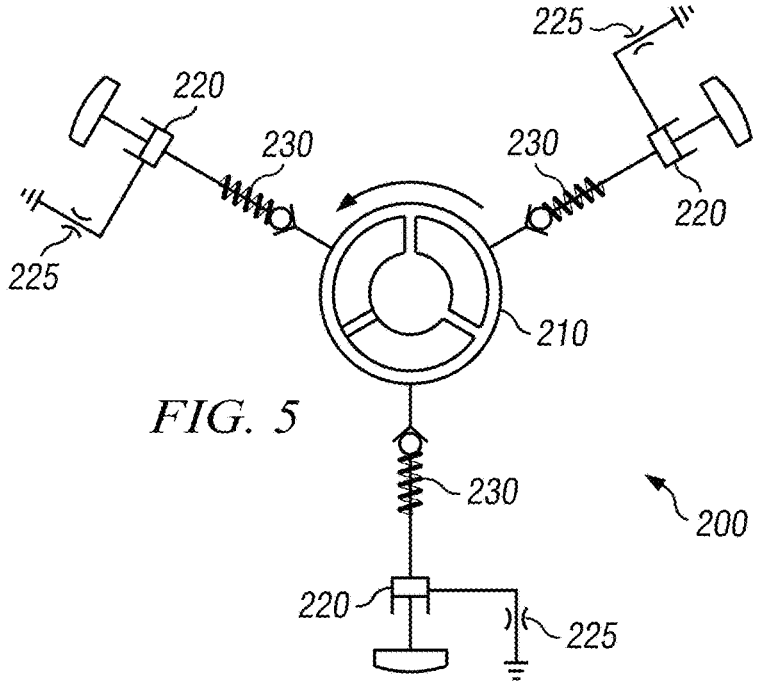
FIG. 5 depicts an example hydraulic circuit that may be employed in a rotary steerable system that makes use of a roll stabilized control unit.

FIG. 5 depicts a hydraulic circuit 200 that may be employed in an RSS that makes use of a roll stabilized control unit. The hydraulic circuit 200 includes a spider valve 210 in fluid communication with first, second, and third pad actuators 220. The spider valve 210 is configured to sequentially connect and disconnect the first, second, and third pad actuators 220 from high pressure drilling fluid as a tool collar rotates with respect to a roll stabilized control unit and therefor to sequentially actuate the RSS pads. As further depicted (and described above) each of the pad actuators 220 may be vented to the wellbore annulus (outside of the RSS) through a corresponding flow restrictor 225. The depicted hydraulic circuit may further optionally include first, second, and third nonreturn (one-way check) valves 230 that provide fluid flow from the spider valve 210 to the corresponding one of the pad actuators while blocking return flow. As described in more detail below, the use of the optional nonreturn valves 230 may provide for improved stick slip, harmonic stick slip, and/or whirl mitigation.

Figure 6A:
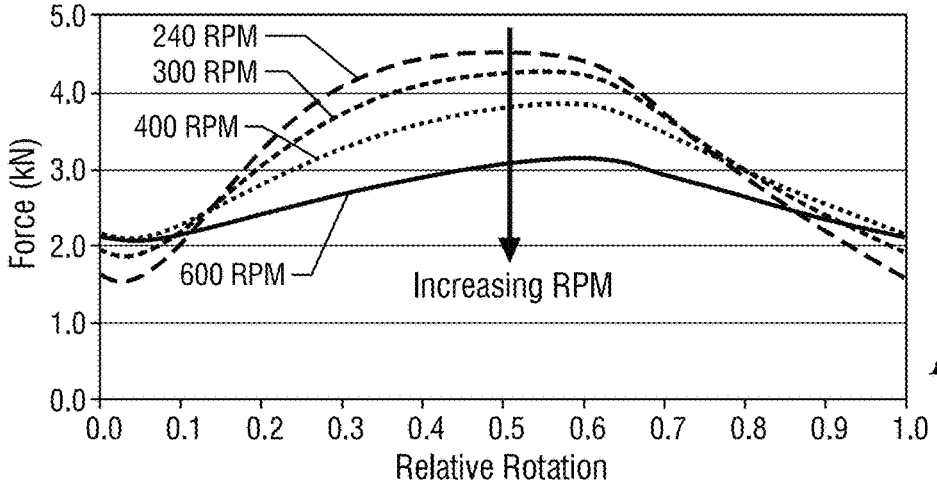
FIGS. 6A and 6B depict plots of steering pad force versus the relative rotational orientation of the roll stabilized control unit with respect to the tool collar for a rotary steerable system employing the hydraulic circuit depicted on FIG. 5.
Figure 6B:
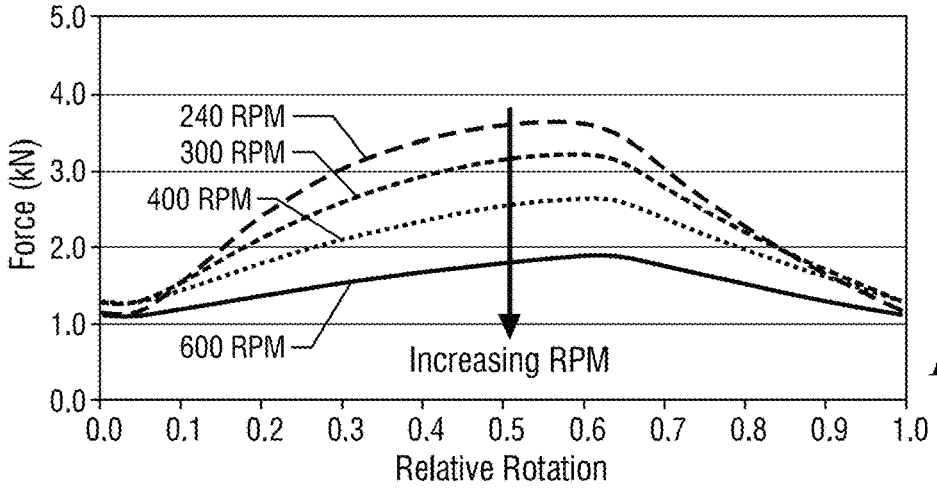

FIGS. 6A and 6B depict plots of steering pad force versus the relative rotational orientation of the roll stabilized control unit with respect to the tool collar at differential rotation rates of 240 rpm, 300 rpm, 400 rpm, and 600 rpm. In FIGS. 6A and 6B, the steering pad force is plotted for hydraulic circuits similar to that depicted on FIG. 5 in which the nonreturn valve 230 is not including added mass (6A) and the nonreturn valve 230 includes 20 grams of added mass to slow the opening motion of the valve thereby impacting performance at higher speeds. Note that in both figures, the pad force decreases significantly with increasing relative rotation speed. In embodiments employing the hydraulic circuit configuration depicted on FIG. 5, rotating the control unit to achieve the high differential rotation rate (above the threshold) results in rapid sequential actuation of the pads which in turn may result, in practice, in simultaneous actuation of the pads but advantageously at a reduced pad force (as compared to the full steering force). The reduced pad force may advantageously reduce wear and tear on the RSS while being sufficient to mitigate stick slip, harmonic stick slip, and/or whirl oscillations.

Figure 7:
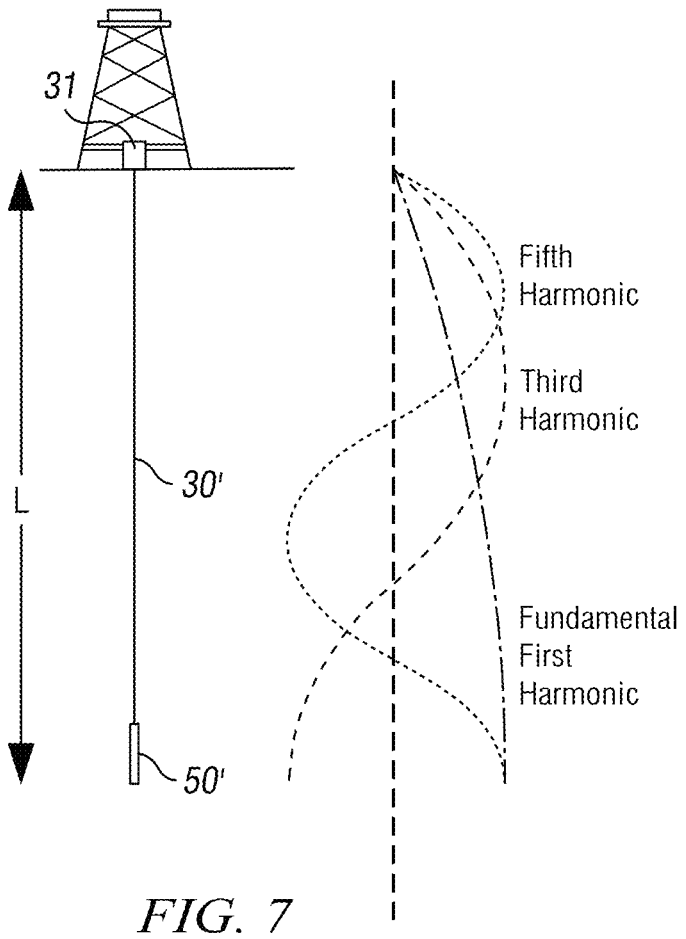
FIG. 7 depicts example stick slip and harmonic stick slip oscillations in which the oscillation amplitude is depicted on the horizonal axis.

FIG. 7 depicts example HSS oscillations in which the stick slip amplitude is depicted on the horizonal axis (the amplitude of the wave). Note that the oscillation occurs along the length of the drill string 30'. In the example depiction, the top drive 31 may be a node for the torsional oscillation and the BHA 50' may be an antinode. It will be appreciated that the actual coupling at the top drive 31 may not be a full node as the control system can provide some coupling which will vary with frequency. Moreover, the BHA 50' tends to be stiffer than the drill string and so tends not to be a perfect antinode. Notwithstanding, to a first approximation, the top drive may be taken to be a node and the BHA (or bit) may be taken to be an antinode.

With continued reference to FIG. 7, the fundamental stick slip frequency of the drill string length may be a quarter wavelength (e.g., $\lambda_F$=4 L). The stick slip period is the reciprocal of the fundamental frequency ($P_{ss}=1/\lambda_F$). As described above, the higher harmonics have shorter wavelengths (and corresponding higher frequencies). For example, the third harmonic may have a wavelength $\lambda_3$=4 L/3, while the fifth harmonic may have a wavelength $\lambda_5$=4 L/5. The frequency may be given as $f=v/\lambda$, where v represents the wave speed in the drill string. The wave speed depends on the shear modulus and density of the drill string and is generally about v≈3,000 m/s. At a well depth of about 3,000 m (about 10,000 ft), the fundamental frequency may be about 0.25 Hz such that the stick slip period may be about 4 seconds.

As described above, the disclosed embodiments may include an automated system (such as an RSS) for drilling a wellbore that mitigates damaging vibrations. The system may include computer hardware and software configured to receive or make stick slip, harmonic stick slip, and/or whirl measurements and to automatically adjust the RSS pads in response to the measurements. The hardware may include one or more processors (e.g., microprocessors) which may be connected to one or more data storage devices (e.g., hard drives or solid state memory) and user interfaces. It will be further understood that the disclosed embodiments may include processor executable instructions stored in the data storage device. The disclosed embodiments are, of course, not limited to the use of or the configuration of any particular computer hardware and/or software.

Although mitigating torsional drill string oscillations has been described in detail, it should be understood that various changes, substitutions and alternations can be made herein without departing from the spirit and scope of the disclosure as defined by the appended claims.

We claim:

1. A wellbore operation comprising:

rotating a drill string in a wellbore, the drill string including a rotary steerable system having at least three pads configured to contact the wellbore wall to steer a direction of drilling;

while rotating the drill string measuring at least one of a harmonic stick slip amplitude and a backward whirl amplitude;

comparing the measured harmonic stick slip amplitude with a corresponding harmonic stick slip threshold or comparing the backward whirl amplitude with a backward whirl threshold, wherein the measured harmonic stick slip amplitude exceeds the harmonic stick slip threshold or the backward whirl amplitude exceeds the backward whirl threshold;

in response to the comparing and determining that the measured harmonic stick slip amplitude exceeds the harmonic stick slip threshold or determining that the backward whirl amplitude exceeds the backward whirl threshold, actuating the at least three pads to promote stick slip oscillations that mitigate harmonic stick slip or backward whirl;

wherein the measuring further comprises measuring a fundamental stick slip frequency; and wherein the actuating simultaneously actuates the at least three pads periodically at the measured fundamental stick slip frequency and out of sync with periodic bursts of drill string rotation rates.

2. The wellbore operation of claim 1, wherein the measuring, the comparing, and the actuating is automatically implemented using a processor deployed in the rotary steerable system.

3. The wellbore operation of claim 1, wherein the actuating simultaneously actuates the at least three pads using independently controlled electronic valves in the rotary steerable system.

4. The wellbore operation of claim 1, wherein:

the rotary steerable system comprises a roll stabilized control unit; and the actuating comprises rotating the roll stabilized control unit in a direction opposite of a direction of the drill string rotation to achieve a differential rotation rate between a rotation rate of the drill string and a rotation rate of the roll stabilized control unit that exceeds 400 rpm.

5. A wellbore operation comprising:

rotating a drill string in a wellbore, the drill string including a rotary steerable system having at least three pads configured to contact the wellbore wall to steer a direction of drilling;

while rotating the drill string measuring at least one of a stick slip amplitude;

comparing the measured stick slip amplitude with a corresponding stick slip threshold, wherein the measured stick slip amplitude exceeds the stick slip threshold;

in response to the comparing and determining that the measured stick slip amplitude exceeds the stick slip threshold, actuating the at least three pads to promote stick slip oscillations that mitigate stick slip;

wherein the measuring further comprises measuring a fundamental stick slip frequency; and wherein the actuating simultaneously actuates the at least three pads periodically at the measured fundamental stick slip frequency and out of sync with periodic bursts of drill string rotation rates.

6. The wellbore operation of claim 5, wherein the measuring, the comparing, and the actuating is automatically implemented using a processor deployed in the rotary steerable system.

7. The wellbore operation of claim 5, wherein the actuating comprises simultaneously actuating the at least three pads using independently controlled electronic valves in the rotary steerable system.

8. The wellbore operation of claim 5, wherein:

the rotary steerable system comprises a roll stabilized control unit; and the simultaneously actuating comprises rotating the roll stabilized control unit in a direction opposite of a direction of the drill string rotation to achieve a differential rotation rate between a rotation rate of the drill string and a rotation rate of the roll stabilized control unit that exceeds 400 rpm.

* * * * *